US008267130B1

(12) United States Patent
Sinnett

(10) Patent No.: US 8,267,130 B1
(45) Date of Patent: Sep. 18, 2012

(54) HANDBAG WITH PADDED POCKETS

(76) Inventor: Georgina Sinnett, Burlington (CA)

( * ) Notice: Subject to any disclaimer, the term of this patent is extended or adjusted under 35 U.S.C. 154(b) by 337 days.

(21) Appl. No.: 12/751,094

(22) Filed: Mar. 31, 2010

(51) Int. Cl.
*A45C 3/06* (2006.01)
*A45C 13/02* (2006.01)

(52) U.S. Cl. ..... 150/112; 150/129; 383/39; 383/111

(58) Field of Classification Search ..... 150/106, 150/112, 129; 206/523, 520; 383/39, 111; 62/457.1
See application file for complete search history.

(56) References Cited

U.S. PATENT DOCUMENTS 1,999,669 A * 4/1935 Smith ..... 150/113
2,674,288 A * 4/1954 Laidlaw ..... 190/115
2,675,042 A * 4/1954 Herrera ..... 150/112
2,825,208 A * 3/1958 Anderson ..... 190/109
3,117,607 A * 1/1964 Siegel ..... 150/117
4,161,201 A * 7/1979 Carp ..... 190/110
4,211,091 A * 7/1980 Campbell ..... 62/372
4,580,667 A * 4/1986 Herwood ..... 190/110
5,048,582 A * 9/1991 Whitfield ..... 150/112
5,427,239 A * 6/1995 Hunt ..... 206/372
5,660,476 A * 8/1997 DeCoster ..... 383/29
5,865,314 A * 2/1999 Jacober ..... 206/570
6,148,959 A * 11/2000 Shay ..... 182/221
6,152,202 A * 11/2000 Magid ..... 150/112

* cited by examiner

*Primary Examiner* — Sue Weaver
(74) *Attorney, Agent, or Firm* — Donald J. Ersler

(57) ABSTRACT

A fashion forward organizing handbag includes a first set of padded pockets, a center pocket and a second set of padded pockets. The center pocket includes a first and second center walls. A plurality of credit card slits are formed in one of the first and second center walls to retain a plurality of cards. A plurality of lengthwise pockets are formed in the other one of said first and second center walls. Each set of padded pockets preferably includes a first padded wall and a second padded wall. The first padded wall has a shorter height than the second padded wall. The second padded wall is attached to one of a first inner padded wall or a second inner padded wall to form a plurality of second padded pockets. The first padded wall is attached to the second padded wall to form a plurality of second padded pockets.

14 Claims, 4 Drawing Sheets

HANDBAG WITH PADDED POCKETS

BACKGROUND OF THE INVENTION

1. Field of the Invention

The present invention relates generally to handbags and more specifically to a fashion forward organizing handbag, which includes a plurality of compartments for safely storing sensitive items.

2. Discussion of the Prior Art

It appears that the prior art does not disclose a handbag with a plurality of compartments for safely storing sensitive and non-sensitive items.

Accordingly, there is a clearly felt need in the art for a fashion forward organizing handbag, which includes a plurality of compartments for safely storing sensitive items, which are subject to damage if stored improperly in a purse.

SUMMARY OF THE INVENTION

The present invention provides a fashion forward organizing handbag, which includes a plurality of compartments for safely storing sensitive items. The fashion forward organizing handbag includes a first set of padded pockets, a center pocket and a second set of padded pockets. The center pocket includes a first center wall and a second center wall. A plurality of credit card slits are formed in one of the first and second center walls to retain a plurality of cards. A plurality of check book/passport/money slits or lengthwise slits are formed in the other one of said first and second center walls. A top of the center pocket is preferably closeable with a zipper or the like. Each set of padded pockets preferably includes a first padded wall and a second padded wall. The first padded wall has a shorter height than the second padded wall. The second padded wall is attached to one of a first inner padded wall or a second inner padded wall of a hand bag to form a plurality of second padded pockets. The first padded wall is attached to the second padded wall to form a plurality of second padded pockets. A top of the fashion forward organizing handbag is preferably closeable with a zipper or the like.

Accordingly, it is an object of the present invention to provide a fashion forward organizing handbag, which includes a plurality of compartments for safely storing non-sensitive and sensitive items, which are subject to damage if stored improperly in a purse.

These and additional objects, advantages, features and benefits of the present invention will become apparent from the following specification.

DETAILED DESCRIPTION OF THE PREFERRED EMBODIMENTS

Figure 1:
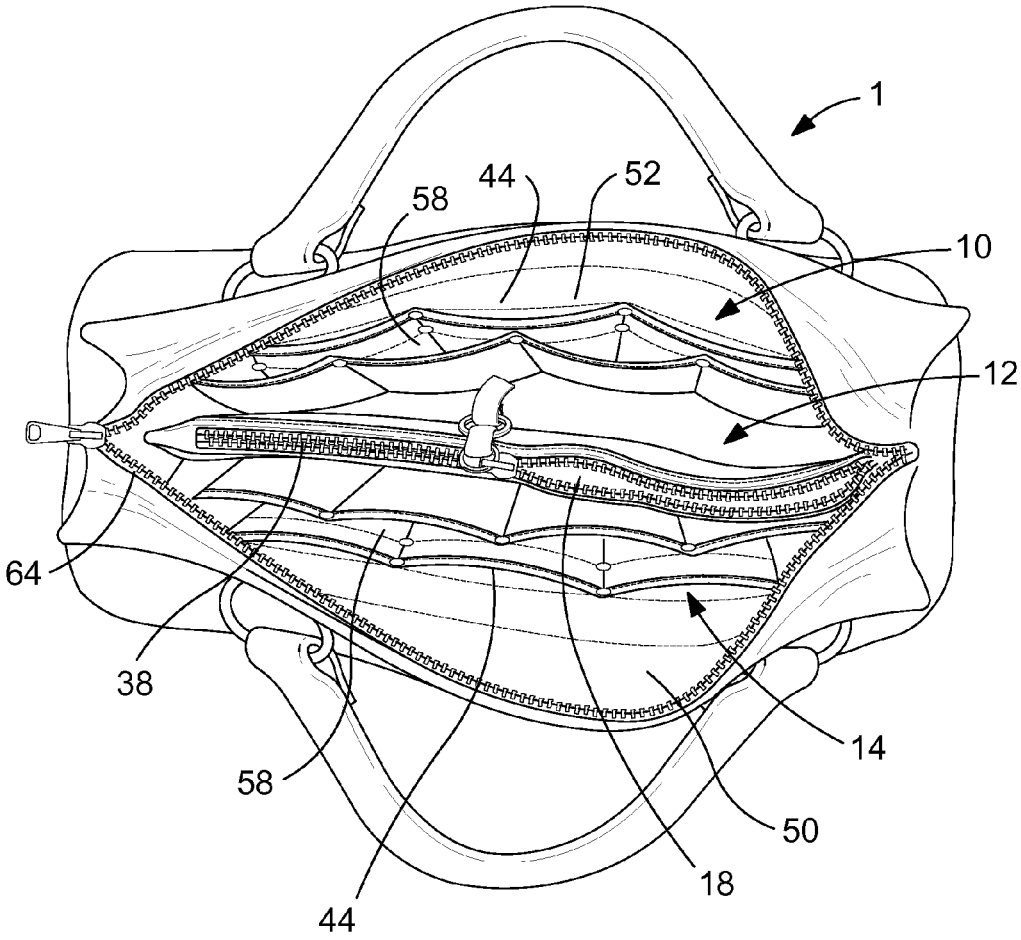
FIG. 1 is a perspective top view of an inside storage area of a fashion forward organizing handbag in accordance with the present invention.
Figure 4:
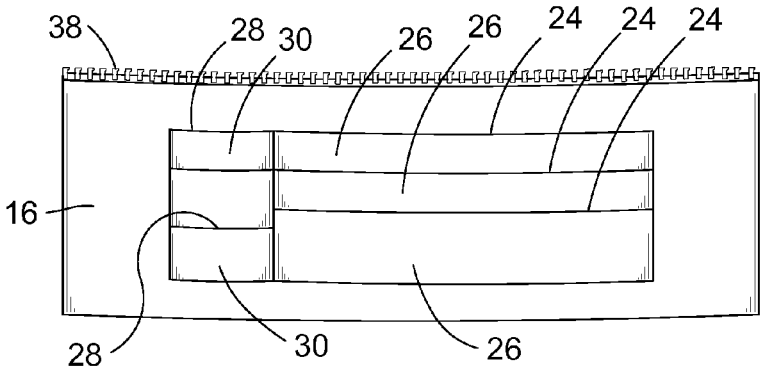
FIG. 4 is a front view of a center wall with a plurality of long slits of a fashion forward organizing handbag in accordance with the present invention.
Figure 6:
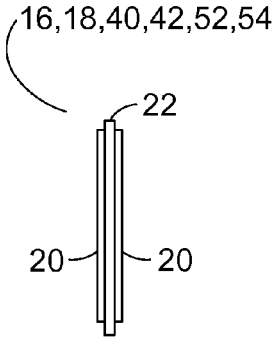
FIG. 6 is a cross sectional view of a padded wall of a fashion forward organizing handbag in accordance with the present invention.
Figure 5:
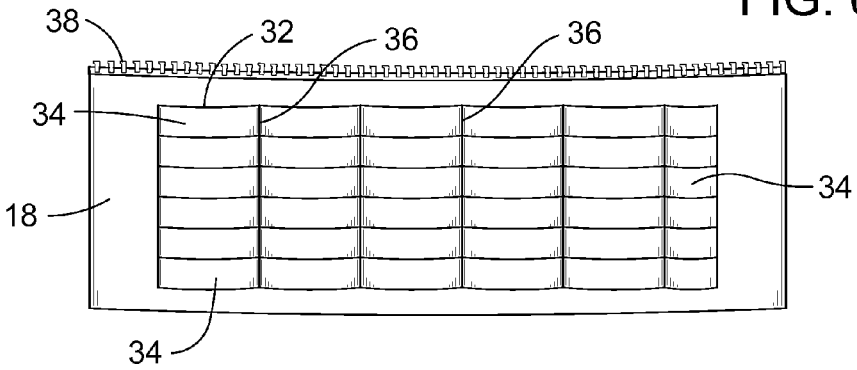
FIG. 5 is a front view of a center wall with a plurality of credit card slits of a fashion forward organizing handbag in accordance with the present invention.

With reference now to the drawings, and particularly to FIG. 1, there is shown a perspective top view of an inside storage area of a fashion forward organizing handbag 1. The fashion forward organizing handbag 1 includes a first set of padded pockets 10, a center pocket 12 and a second set of padded pockets 14. With reference to FIGS. 4-6, the center pocket 12 includes a first center wall 16 and a second center wall 18. The first and second center walls preferably include two outer fabric layers 20 and an inner foam layer 22. Three check book/passport/money slits or lengthwise slits 24 are preferably formed by sewing three perimeter edges of a strip of material 26 to the first center wall 16. Three business card slits 28 are preferably formed by sewing three perimeter edges of a strip of material 30 to the first center wall 16, adjacent the three check book/passport/money slits 24. A plurality of credit card slit pockets 32 are formed by sewing three perimeter edges of a strip of material 34 and sewing a plurality of vertical dividers 36 to the second center wall 18. A top of the center pocket 12 preferably includes a zipper 38 or any other suitable closure device.

Figure 2:
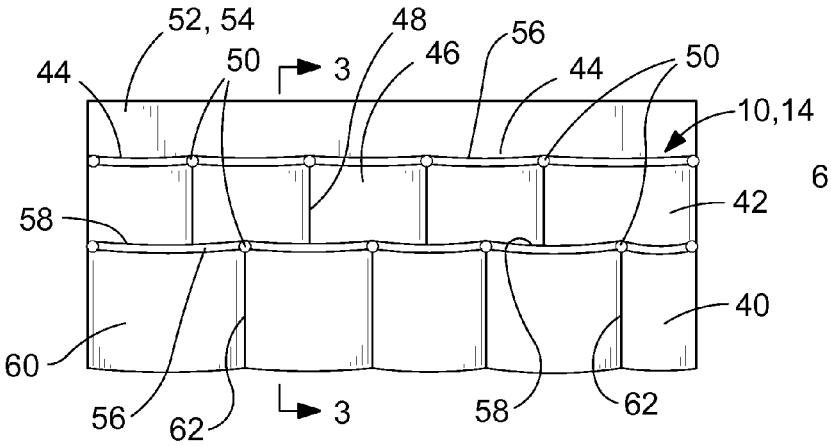
FIG. 2 is a front view of a first or second set of padded pockets of a fashion forward organizing handbag in accordance with the present invention.
Figure 3:
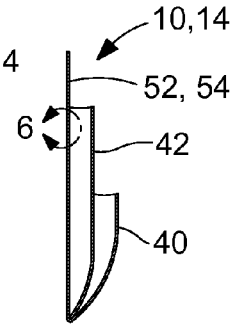
FIG. 3 is a cross sectional view of a first or second set of padded pockets of a fashion forward organizing handbag in accordance with the present invention.

With reference to FIGS. 2-3, each set of padded pockets 10, 14 preferably includes a first padded wall 40 and a second padded wall 42. The first padded wall 40 has a shorter height than the second padded wall 42. A plurality of padded pockets 44 are preferably formed by sewing three perimeter edges of a strip of material 46, sewing a plurality of vertical dividers 48 and attaching a plurality of rivets 50 to one of a first inner padded wall 52 or a second inner padded wall 54 of the fashion forward organizing handbag 1. A width of a wear strip 56 is preferably formed into an inverted U-shape and sewn over a top of the strip of material 46, before the strip of material 46 is sewn to the first or second inner padded wall 52. The first and second padded walls preferably each include the two outer fabric layers 20 and the inner foam layer 22.

A plurality of padded pockets 58 are preferably formed by sewing three perimeter edges of a strip of material 60, sewing a plurality of vertical dividers 62 and attaching the plurality of rivets 50 to the second padded wall 42. The wear strip 56 is preferably sewn over a top of the strip of material 60, before the strip of material 46 is sewn to the second padded wall 42. A top of the fashion forward organizing handbag 1 preferably includes a zipper 64 or any other suitable closure device. The first and second padded walls preferably each include the two outer fabric layers 20 and the inner foam layer 22.

The plurality of padded pockets 58 formed between the first inner padded wall 52 and the second padded wall 42 are staggered relative to the plurality of padded pockets 58 formed between the first padded wall 40 and the second padded wall 42. The plurality of padded pockets 58 formed between the second inner padded wall 54 and the second padded wall 42 are staggered relative to the plurality of padded pockets 58 formed between the first padded wall 40 and the second padded wall 42.

Figure 7:
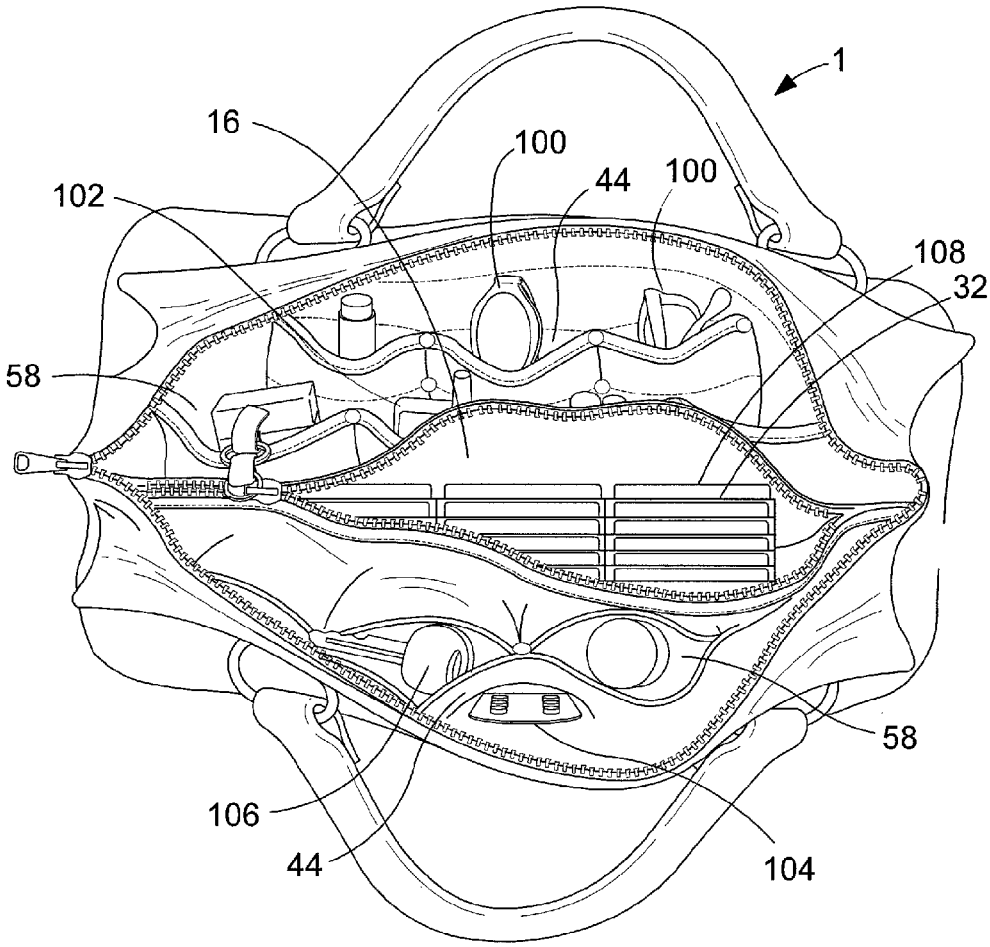
FIG. 7 is a perspective top view of an inside storage area of a fashion forward organizing handbag with a plurality of items inserted into a plurality of pockets in accordance with the present invention.
Figure 8:
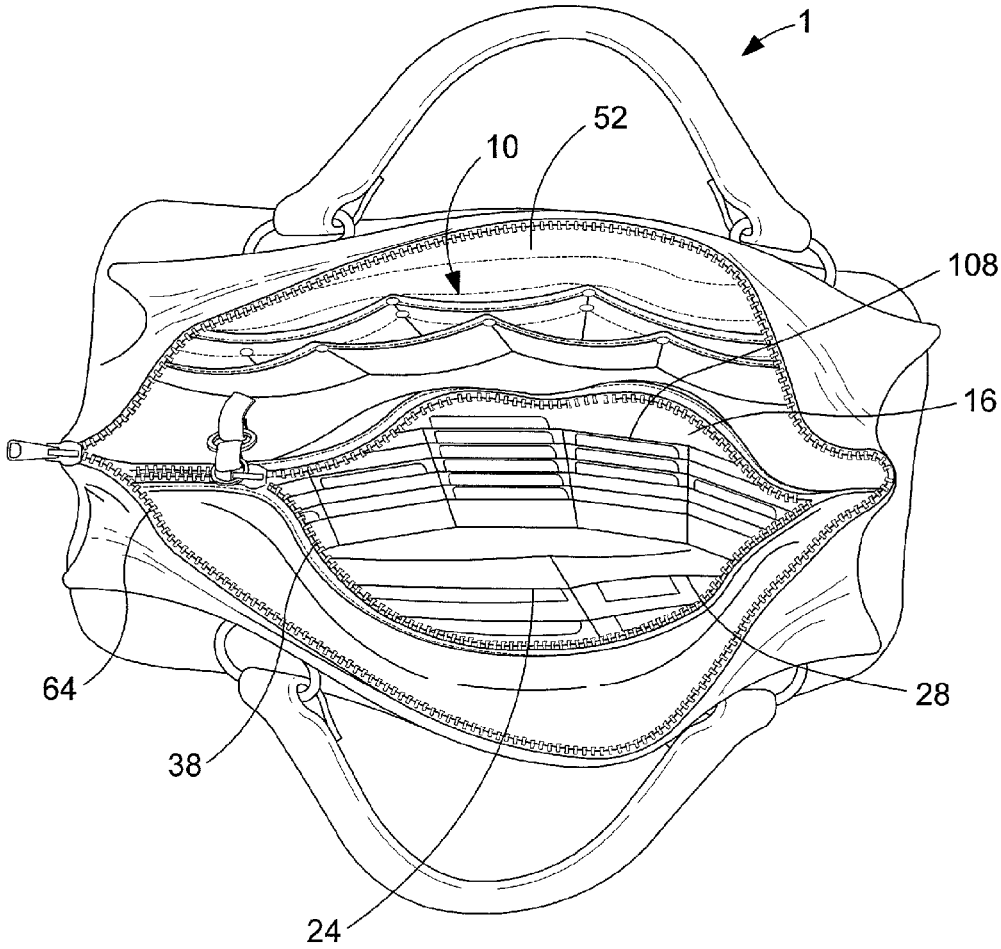
FIG. 8 is a perspective top view of an inside storage area of a fashion forward organizing handbag in accordance with the present invention.

FIG. 7 shows a plurality of items, such as glasses 100, a cell phone 102, a pill blister strip 104, keys 106 retained in the plurality of padded pockets 44, 58 and a plurality of cards 108 retained in a plurality of credit card slits 32. FIG. 8 shows the plurality of credit cards 108 retained in the plurality of credit card slits 32.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A fashion forward organizing handbag, comprising:

a first inner padded wall;

a second inner padded wall;

a center pocket includes a first center wall and a second center wall, a plurality of center pockets are formed on at least one of said first and second center walls;

a first padded wall is attached to said first inner padded wall to form at least three first padded pockets, a second padded wall is attached to said first padded wall to form at least three second padded pockets, said at least three first padded pockets are staggered relative to said at least three second padded pockets; and a third padded wall is attached to said second inner padded wall to form at least three third padded pockets, a fourth padded wall is attached to said third padded wall to form at least three fourth padded pockets.

2. The fashion forward organizing handbag of claim 1 wherein:

each one of said padded walls includes two outer fabric layers and a foam inner layer.

3. The fashion forward organizing handbag of claim 1 wherein:

a width of a wear strip is formed into an inverted U-shape and sewn over a top of each one of said padded walls.

4. The fashion forward organizing handbag of claim 1 wherein:

a top of said center pocket is closeable with a closure device.

5. The fashion forward organizing handbag of claim 1 wherein:

said second padded wall has a shorter height than said first padded wall.

6. A fashion forward organizing handbag, comprising:

a first inner padded wall;

a second inner padded wall;

a center pocket includes a first center wall and a second center wall, said center pocket is located between said first and second inner padded walls, a plurality of first center pockets are formed on said first center wall, a plurality of second center pockets are formed on said second center wall;

a first padded wall is attached to said first inner padded wall to form at least three first padded pockets, a second padded wall is attached to said first padded wall to form at least three second padded pockets, said at least three first padded pockets are staggered relative to said at least three second padded pockets; and a third padded wall is attached to said second inner padded wall to form at least three third padded pockets, a fourth padded wall is attached to said third padded wall to form at least three fourth padded pockets.

7. The fashion forward organizing handbag of claim 6 wherein:

each one of said padded walls includes two outer fabric layers and a foam inner layer.

8. The fashion forward organizing handbag of claim 6 wherein:

a width of a wear strip is formed into an inverted U-shape and sewn over a top of each one of said padded walls.

9. The fashion forward organizing handbag of claim 6 wherein:

a top of said center pocket is closeable with a closure device.

10. A fashion forward organizing handbag, comprising:

a first inner padded wall;

a second inner padded wall;

a center pocket includes a first center wall and a second center wall, a plurality of center pockets are formed on at least one of said first and second center walls;

a first padded wall is attached to said first inner padded wall to form at least three first padded pockets, a second padded wall is attached to said first padded wall to form at least three second padded pockets, said at least three first padded pockets are staggered relative to said at least three second padded pockets, a plurality of rivets are used to attach said first padded wall to said first inner padded wall to form said at least three first padded pockets; and a third padded wall is attached to said second inner padded wall to form at least three third padded pockets, a fourth padded wall is attached to said third padded wall to form at least three fourth padded pockets.

11. The fashion forward organizing handbag of claim 10 wherein:

each one of said padded walls includes two outer fabric layers and a foam inner layer.

12. The fashion forward organizing handbag of claim 10, further comprising:

a plurality of rivets are used to attach said first padded wall to said first inner padded wall to form said at least three first padded pockets.

13. The fashion forward organizing handbag of claim 10 wherein:

a width of a wear strip is formed into an inverted U-shape and sewn over a top of each one of said padded walls.

14. The fashion forward organizing handbag of claim 10 wherein:

a top of said center pocket is closeable with a closure device.

* * * * *